United States Patent [19]

Adler

[11] 4,318,794

[45] Mar. 9, 1982

[54] ANODE FOR PRODUCTION OF ELECTRODEPOSITED FOIL

[76] Inventor: Edward Adler, 266 Arch Rd., Englewood, N.J. 07631

[21] Appl. No.: 207,239

[22] Filed: Nov. 17, 1980

[51] Int. Cl.[3] ..... C25D 17/00; C25D 1/04

[52] U.S. Cl. ..... 204/216; 204/13

[58] Field of Search ..... 204/212, 216, 218, 13, 204/290 F

[56] References Cited

U.S. PATENT DOCUMENTS

| | | | |
|---|---|---|---|
| 3,461,046 | 8/1969 | Clancy | 204/216 |
| 3,674,656 | 7/1972 | Yates | 204/216 |
| 4,053,370 | 10/1977 | Yamashita | 204/13 |

FOREIGN PATENT DOCUMENTS

| | | | |
|---|---|---|---|
| 2355569 | 5/1975 | Fed. Rep. of Germany | 204/212 |

*Primary Examiner*—T. M. Tufariello

*Attorney, Agent, or Firm*—McAulay, Fields, Fisher, Goldstein & Nissen

[57] ABSTRACT

The apparatus for electrodeposition of a metal includes a cylindrical cathode which is rotated about a horizontal axis and is partly submerged in an electrolyte, the cylindrical cathode having a surface layer thereon upon which metal from the electrolyte may be deposited and from which a deposited layer of the metal may be stripped, comprising a plurality of strips of dimensionally stable anode, means for supporting each of the plurality of strips parallel to the horizontal axis and spaced a predetermined distance from the surface layer to form a generally annular space between the surface and the plurality of strips extending about substantially the entire portion of the surface layer which is submerged in the electrolyte.

14 Claims, 6 Drawing Figures

ANODE FOR PRODUCTION OF ELECTRODEPOSITED FOIL

The present invention relates to electrodeposition apparatus and, particularly, to apparatus for electrodepositing foil from an electrolyte onto the surface of a cylindrical cathode drum which is rotated through the electrolyte and more particularly to improvements in anode apparatus used therein.

The production of electrodeposited foil, especially electrodeposited copper foil, is of considerable importance because of its use, for example, in the production of printed circuits for electronic and electrical equipment. The production of such electrodeposited copper foil is commonly carried out by partially immersing and rotating a cylindrical cathode in an appropriate copper electrolyte. When the surface of the cathode cylinder emerges from the electrolyte, the metallic foil electrodeposited thereupon is stripped from said surface and coiled on a roll. The time of rotation and the cathode current density are adjusted to produce the required thickness of foil by electrodeposition in the time of immersion of the cathode in the electrolyte.

Copper is deposited by cathode current at the rate of $3.293\times10^{-4}$ grams/coulomb or 1.1855 grams/ampere hour for 100% cathode efficiency.

If the distance between anode and cathode varies from one area to another, the cathode current density in the area of greater distance is less. This leads to a deposition of less thickness per unit time in the area having wider spacing.

To ensure uniform thickness of deposited foil, anodes are usually formed concentric to the rotating drum cathode with uniform spacing between the drum cathode and the stationary anode(s). For convenience two anodes are usually used, each somewhat less in length than one-quarter the circumference of the drum cathode. Although soluble copper anodes can be used, insoluble anodes such as lead are preferred. Maintaining uniform spacing between anode and cathode is easier with insoluble anodes since non-uniform dissolution of the soluble anodes may occur. It is common practice to machine the concave side of the anodes to provide an annular spacing between anode and cathode of approximately 1 to 2 cm. ±0.2% to 0.4% or so.

To desirably provide uniform copper deposition, each element of area along any line on the drum cathode surface parallel to the drum axis must in, a revolution of a drum, receive the same number of coulombs of electricity at the same averaged current efficiency, and thus receive the same amount of plated copper. To accomplish this, each element of area along a line across the surface must follow a path such that the integrated distances between anode and cathode are substantially the same.

A supply of electrolyte is typically provided across the bottom of the drum cathode by a manifold which rises between the cathode and anode. With insoluble anodes, in the commonly used copper sulfate-sulfuric acid electrolyte, oxygen is released at the anode surface. The bubbles of oxygen so produced move upward through the annular space between the anode and cathode along with the electrolyte providing violent agitation, in degree according to the current used and the spacing.

When the metal ions in the solution boundary layer adjacent the drum cathode are depleted, the maximum rate or current density at which smooth plating of copper can be achieved is reduced. The upward motion of the bubbles provides increased velocity and agitation to the flow of electrolyte through the annular channel. It is commonly understood in the art of electrodeposition that increasing the velocity and turbulence of the electrolyte replenishes the copper in the boundary layer adjacent to the cathode surface and enables the use of higher current density without burning or roughening the deposited layer and hence allows for increasing the rate of deposition. If the anode current density is uniform, oxygen bubbles are uniformly released on the entire surface of the anode at a uniform volume per unit area of anode. However, there are more bubbles in the electrolyte at the higher levels of the anode. The bubbles from the bottom portion are increased in volume as they move up by the reduction in hydrostatic pressure and are supplemented by the bubbles of oxygen released at upper areas, leading to a condition of higher agitation and solution velocity in the electrolyte at the higher levels.

U.S. Pat. No. 3,674,656 describes the production of a roughened surface on the copper foil employing a secondary or super anode facing the emerging portion of the cathode to which a higher voltage is applied as compared to the voltage applied to the remainder of the anode thus resulting in a higher current density in the facing portion of the cathode. The necessity to insulate the secondary electrode from the primary electrode, and the requirement for a separate power supply to provide a different voltage and current density, adds to the complexity and cost of the apparatus.

Although lead anodes are commonly called "insoluble" anodes, they are neither truly insoluble nor permanent. In anodic usage, lead dioxide is produced at the surface of the anode and oxygen is liberated from the lead oxide surface rather than at the metallic lead surface, i.e. if a clean lead surface is made anodic, lead dioxide is first produced before oxygen evolution takes place. In continued usage, the lead dioxide is partially dissolved and partially flaked off. The spacing between the anode and cathode is accordingly increased and increased voltage is required to maintain a given current density or total current for the total immersed area, due to the increased resistance of the wider electrolyte spacing. The increased voltage results in an increased power and energy consumption per pound of copper produced with correspondingly increased heat and requisite cooling requirements. Also, for a given current density a given volume of oxygen bubbles are produced in unit time. The bubbles agitate the solution and effectively increase the solution velocity near the cathode. A wider spacing reduces the agitation and influence of the bubbles at the cathode surface and leads to a lower solution velocity and hence permits a lower maximum current density without burning of the electrodeposit (Burning being a term of art applied to the production of powdery or rough electrodeposit occurring at excessive current density).

In commercial production of electrodeposited copper foil, cathode and anode current densities from 2–6 amp. per sq. in. are commonly used. The lead anodes commonly used are frequently alloyed with from 2–20% antimony and lesser quantities of tin and, occasionally, with silver and other metals. These lesser alloy constituents are used to impart improved strength and mechanical properties to the lead and hence to prevent sagging or creep of the heavy lead anodes and also to improve the life of the anodes in usage, i.e. to diminish the rate of attack or wear of the lead anodes. In the course of the operation, as the lead anode wears away, the portions worn away are ultimately converted to lead sulfate sludge to the extent in a commercial drum operation of from 50–100 lbs. or so of lead sulfate per day. This quantity of lead sulfate sludge including an amount of antimony or other alloyed metals represents a nuisance and must be filtered off to prevent or minimize porosity in the copper foil and to prevent accumulations of lead sulfate in the system with detrimental effects to the production operation. The disposal of the lead sulfate and the antimony constitutes an environmental problem.

An exponential relationship exists between anode erosion and anode current density. At sufficiently high current densities, lead anodes erode so rapidly that their use is impractical.

When lead anodes erode sufficiently after about 8 to 18 months of operation to increase the annular distance between anode and cathode to about an inch, the anodes are usually either taken out and replaced or physically moved toward the cathode to restore the desired spacing. In either case, the surface of the anode must again be machined to conform the concave surface of the anode to the cylindrical surface of the cathode with a uniform annular spacing therebetween. Using either method, a delay of up to several days or a week or more is experienced during which the unit is out of service and its production is lost.

In a separate electrolytic industry, namely the electrolytic production of chlorine from a salt solution, insoluble graphite electrodes were previously used. In the last ten years or so, insoluble anodes of a new and improved type have been introduced to the chlorine industry. These anodes, trademarked DSA (dimensionally stable anodes), were invented by H. Beer and comprise a mixed oxide coating of a platinum metal oxide, preferably ruthenium oxide, and titanium oxide applied to and adherent to a titanium metal substrate. The substrate is preferably of expanded metal to increase the area exposed to the electrolyte with a minimum of material. These dimensionally stable anodes have been very successful in the electrolytic chlorine industry and have largely supplanted the previously used graphite electrodes which latter suffered from similar types of defects to those exhibited by the lead anodes described previously. Dimensionally stable anodes have also been developed for use in electrolytic systems where oxygen rather than chlorine is evolved at the anode. The exact composition of the active layer on the substrate of these anodes is proprietary. Dimensionally stable anodes have been used in some electrolytic systems evolving oxygen where straight or flat anode sheets are usually satisfactory, but have not been successfully applied to the production of copper foil where large curved anodes of substantial geometric uniformity are required. In situations where they have been used, their ability to supply high current densities and high currents have been more important than a requirement for providing substantially uniform current density over a large area.

One of the reasons for the problems in obtaining geometrical uniformity lies in the process for producing DSA. This involves a multi-step operation including the application to the substrate of precursors of coating oxides with baking at elevated temperatures between successive coating steps. Such heating and cooling frequently causes warping of electrodes large enough for copper foil production (typically in the neighborhood of 3–5 ft. by 5–6 ft.) to an extent which makes it difficult to maintain the uniformity of annular spacing required for uniform copper foil thickness. Post machining on the oxide coated titanium to restore its original shape cannot be used since this would remove the oxide layer itself.

It is an object of the present invention to provide an improved anode of the DSA type for use in electrodeposited metal foil production, especially electrodeposited copper foil production.

It is a further object of the present invention to provide a dimensionally stable anode which can be quickly changed.

It is a further object of the invention to provide an anode giving longer life and requiring less maintenance.

It is a further object of the invention to provide an anode for electrodeposition of metal foil which does not add substantial amounts of contaminants to the electrolyte.

According to an aspect of the present invention, there is provided an apparatus for electrodeposition of a metal on a cylindrical cathode which is rotated about a horizontal axis and is partly submerged in an electrolyte, the cylindrical cathode having a surface layer thereon upon which metal from the electrolyte may be deposited and from which a deposited layer of the metal may be stripped, comprising a plurality of strips of dimensionally stable anode, means for supporting each of the plurality of strips parallel to the horizontal axis and spaced a predetermined distance from the surface layer to form a generally annular space between the surface and the plurality of strips extending about substantially the entire portion of the surface layer which is submerged in the electrolyte.

According to a feature of the present invention, there is provided an apparatus for electrodeposition of metal on a cylindrical cathode which is rotated about a horizontal axis and is partly submerged in an electrolyte, the cylindrical cathode having a surface layer thereon upon which metal from the electrolyte may be electrodeposited and from which a deposited layer of the metal may be stripped, comprising a backer plate spaced a first predetermined substantially uniform distance from the surface layer from a point where the surface layer enters the electrolyte to a point located a second predetermined distance below where the surface layer emerges from the electrolyte to form a substantially uniform annular space, strips of dimensionally stable anode having a plurality of holes therein which are effective to permit substantially free communication of the electrolyte from one side to the other thereof, means for supporting said strips a third predetermined substantially uniform distance away from the cylindrical cathode at least around a substantial portion of the cylindrical cathode which is submerged in the electrolyte, and means for flowing electrolyte into the annular space at a low point thereof in sufficient quantity to produce a flow velocity therethrough in the annular space which flow velocity is high enough to substantially increase a maximum current density on the cylindrical cathode for the deposition of smooth metal thereon.

Other features and advantages of the present invention will become apparent from a consideration of the following detailed description when taken in conjunction with the accompanying drawings, in which.

Figure 1:
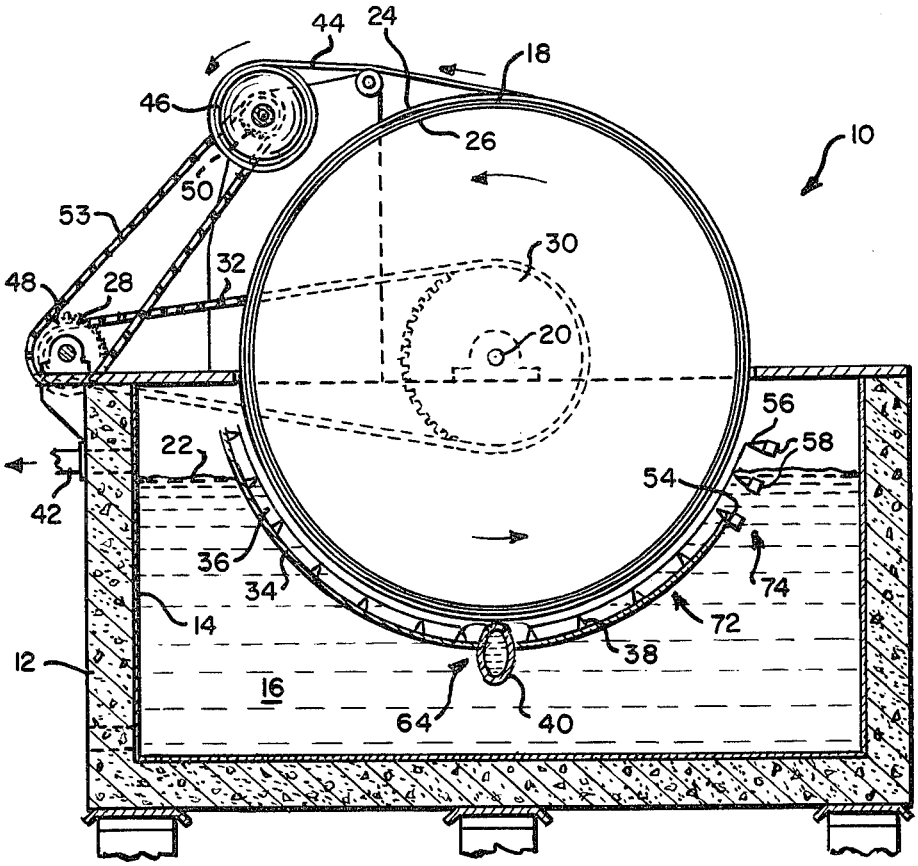
FIG. 1 is a cross section of an electrodeposition apparatus according to an embodiment of the present invention.

Referring now to FIG. 1, there is shown, generally at 10, an electrodeposition apparatus according to an embodiment of the present invention. A vessel 12, suitably of concrete, includes a lining 14 having properties satisfactory to resist attack by an electrolyte bath 16 therein.

A cylindrical cathode 18 of any conventional type rotates on an axis 20 with about 40% of its circumference below a fluid level 22 of electrolyte bath 16. Cylindrical cathode 18 conventionally includes a surface layer 24 upon which a metal foil may be electrodeposited but from which the metal foil is readily stripped without tearing or other damage. Surface layer 24 may be of stainless steel, titanium, zirconium, tantalum or other suitable material over an inner drum 26 of steel, stainless steel, copper, copper alloy or other material. Conventionally, the negative dc supply is applied through axis 20 to inner drum 26 from whence it is delivered through the thickness dimension of surface layer 24.

Drive means including a motor (not shown), drive sprockets 28 and 30 and a drive chain 32 are employed to rotate cylindrical cathode 18 at a circumferential speed which permits surface layer 24 to remain in contact with electrolyte bath 16 for a sufficient time to develop the desired thickness of foil.

A concave backing plate 34 is uniformly spaced from surface layer 24 and supports a dimensionally stable anode 36 a predetermined small distance, preferably about 0.5 inch, away from surface 24 using any convenient means such as, for example, bolts or standoffs 38.

An electrolyte supply conduit 40 provides a flow of electrolyte in the annular space between dimensionally stable anode 36 and cylindrical cathode 18. The electrolyte flows upward through this annular space and overflows to electrolyte bath 16 at the top of backing plate 34. Backing plate 34 may be of any suitable material which is capable of withstanding attack by the electrolyte and may be formed as a single piece or as two or more sections. Backing plate 34 may be, for example, a conventional lead anode which has been machined off sufficiently to leave space for the installation of standoffs 38 and dimensionally stable anode 36. Alternatively, backing plate 34 may be of titanium, rigid polyvinyl chloride, or other material. Positive dc electric power is provided, either through backing plate 34 and standoffs 38 or through other conductors (not shown) to dimensionally stable anode 36. Since dimensionally stable anode 36 is very much closer to the surface of cylindrical cathode 18 than is backing plate 34, substantially all of the anodic electrochemical reaction takes place at dimensionally stable anode rather than at backing plate 34. Thus, even if lead anode is employed as a backing plate, the erosion and sludge problems which make the use of lead anodes undesirable is substantially reduced. A corrosion-resisting layer may be applied to the surface of the lead anode to substantially eliminate erosion and sludge.

Fluid level 22 is maintained substantially constant in the face of a continuously replenished supply through electrolyte supply conduit 40 by an overflow conduit 42 which feeds the overflow to replenishment apparatus (not shown).

The foil deposited on surface layer 24 is stripped off surface layer 24 as a foil sheet 44 which is coiled on a reel 46. Reel 46 is driven by drive sprockets 48 and 50 and a drive chain 52. Drive sprockets 28 and 48 are preferably coordinated so that the reel-up rate of foil sheet 44 on reel 46 is substantially equal to the peripheral speed of surface layer 24.

As previously noted, the method of producing dimensionally stable anodes substantially forecloses the possibility of forming structures as large as dimensionally stable anode 38 with the relatively precise dimensional requirements needed for electrodeposition of foil. This problem is solved in dimensionally stable anode 36 by employing relatively narrow strips of dimensionally stable anode material extending from end to end of cylindrical cathode 18 between adjacent standoffs 38. If the strips are planar and relatively narrow in the direction of motion of cylindrical cathode 18 compared to the radius of cylindrical cathode 18, the difference between maximum and minimum spacing can be maintained at a satisfactory small value. For example, if cylindrical cathode 18 has a diameter of 92.5 inches and the center of a strip of dimensionally stable anode is spaced 0.5 inch outward from surface layer 24, the following table relates the width of strip to the percent difference in spacing between center and end of the strip from surface layer 24.

| Width of Strip (in.) | Radial Distance From Axis of Cathode to Center of Strip (in.) | Radial Distance From Axis to End of Strip (in.) | Difference in Radial Distance (in.) | % Difference in Spacing |
|---|---|---|---|---|
| 1 | 46.75 | 46.7527 | .0027 | 0.54 |
| 2 | 46.75 | 46.7607 | .0107 | 2.14 |
| 3 | 46.75 | 46.7741 | .0241 | 4.82 |
| 4 | 46.75 | 46.7928 | .0428 | 8.56 |
| 6 | 46.75 | 46.84616 | .09616 | 19.23 |

As shown in the table above, in order to maintain the spacing within about 10 percent between cylindrical cathode 18 and the center and edges of a strip of dimensionally stable anode, the widths of the strips must be kept to about 4 inches or less. It is believed that planar strips between about 2 and about 6 inches will perform satisfactorily.

If the strips of dimensionally stable anode are curved or bent to conform them more closely to the curvature of cylindrical cathode 18, wider strips may be used. Although not shown in FIG. 1, additional stiffening rods or other structures may be employed to support sections of dimensionally stable anode 36.

Although the preceding description has been with respect to substantially uniform spacing between dimensionally stable anode 36 and cylindrical cathode 18 at all points, variations in the radial distance of dimensionally stable anode 36 from cylindrical cathode 18 may be desirable at selected points in the direction of motion of cylindrical cathode 18. For example, at the lowest point on cylindrical cathode 18, burning may occur due to the fact that bubbles have not evolved in this area to enhance solution velocity to agitation. Thus, in this region, it may be desirable to increase the spacing somewhat in order to avoid burning in this region. Furthermore, the conditions of deposition may affect the grain structure and other properties of the copper foil. The ability to vary the radial distance of dimensionally stable anode 36 from surface layer 24 and the flow velocity permits control of such grain structure and other properties.

Backing plate 34 preferably terminates at a point 54 which is substantially below fluid level 22. Dimensionally stable anode 36 continues past termination point 54 to end at point 56 which is at, or above fluid level 22. In order to support the strips of dimensionally stable anode 36 beyond termination 54, backing plate 34, crossbars 58 or other means may be employed which permit the flow of electrolyte therebetween.

Figure 2:
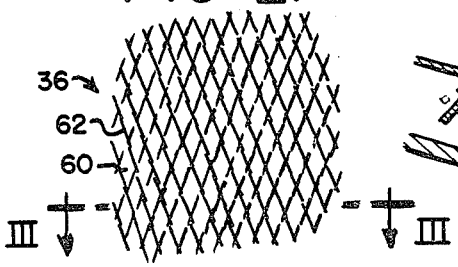
FIG. 2 is a closeup view of the surface of a flat panel of dimensionally stable anode such as used in the apparatus of FIG. 1.

Referring now to FIG. 2, a section of dimensionally stable anode 36 is shown. Dimensionally stable anode 36 is a foraminous expanded metal structure in which a sheet of metal is slit with parallel slits and is then subject to edgewise force to open the slits into diamond-shaped openings 60 separated by relatively narrow strips of metal 62. By employing expanded metal in dimensionally stable anode 36, a much greater surface area of anode is exposed to the electrolyte and thus a relatively low anodic current density is achievable leading to a substantially longer anode life. Other forms of dimensionally stable anode having more or less openness and including substantially no openings may be employed without departing from the present invention.

Figure 3:
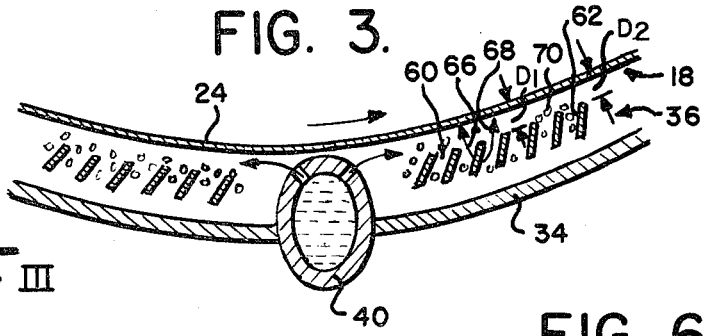
FIG. 3 is an enlarged cross section of a portion of the apparatus near the bottom of the cylindrical cathode of FIG. 1.

Referring now to FIG. 3, which is a section taken through a region indicated by an arrow 64 at the bottom of cylindrical cathode 18, a distance D1 between about the center of a planar strip of dimensionally stable anode 36 and surface layer 24 is slightly smaller than a distance D2 between the end of a strip of dimensionally stable anode 36 and surface layer 24. However, if the strips of dimensionally stable anode 36 are relatively narrow compared to the circumference of surface layer 24, this slight difference in distance provides a substantially uniform spacing and does not interfere with satisfactory electrodeposition of foil since element of area along a line across the surface of cylindrical cathode 18 parallel to the axis thereof must follow a path having an integrated distance to the anode which is substantially equal to that experienced by every other element of area along the line.

Due to the openness of dimensionally stable anode 36, the anodic electrolytic reaction takes place on dimensionally stable anode 36 not only at the surfaces of strips of metal 62 facing surface layer 24 as indicated by arrow 66 but also at the side and rear surfaces of strips of metal 62 as indicated by curved arrow 68. Thus, an increased current density is achievable at a lower voltage. This effect is enhanced by the catalytic effect of the material in the coating on dimensionally stable anode 36.

During the electrochemical reaction, bubbles of oxygen 70 are evolved at the surface of dimensionally stable anode 36 and are swept along by the flow of electrolyte injected into the space between dimensionally stable anode 36 and surface layer 24. The movement of electrolyte caused by the flow from electrolyte supply conduit 40 provides a fluid velocity which, as is well known, increases the current density which may be supported without producing a powdery or rotten metallic layer on surface layer 24.

Figure 4:
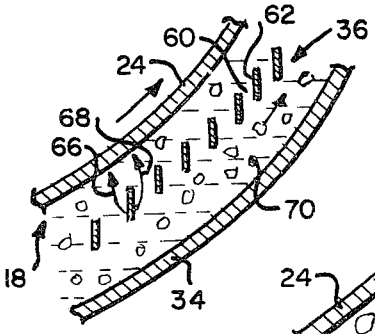
FIG. 4 is an enlarged cross section of a portion of the apparatus of FIG. 1 downstream from the portion shown in FIG. 3.

Referring now to FIG. 4 which illustrates a region indicated by an arrow 72 in FIG. 1, bubbles 70 in this location include, not only those being evolved from the portion of dimensionally stable anode 36 in this location, but also those which are swept along from upstream regions due to the flow of replenishment electrolyte. These previously-evolved bubbles which have expanded substantially due to the reduced hydrostatic pressure at this point, occupy a substantial portion of the volume and thus produce a greater fluid velocity of the electrolyte than was experienced in upstream locations. Thus, substantially improved capability for supporting high cathode current density without burning is experienced in this area. It should thus be clear that the current density sustainable without burning can be controlled by controlling the spacing between surface layer 24 and backing plate 34 which, in turn, controls the fluid velocity.

Figure 5:
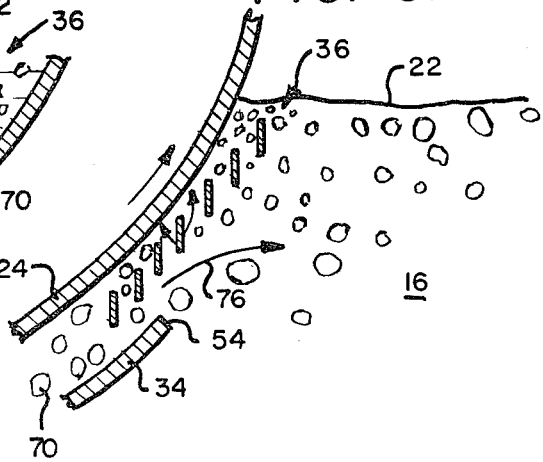
FIG. 5 is an enlarged cross section of the apparatus further downstream from FIG. 4.

Referring now to FIG. 5, which is taken in a region indicated by an arrow 74 in FIG. 1, at termination point 54 of backing plate 34, the rapid flow of electrolyte containing now relatively large bubbles 70 is now able to escape into the main body of electrolyte bath 16 as shown by a curving arrow 76. Openings 60 in this region are preferably large enough to permit relatively free relief of fluid therethrough. The fluid velocity of electrolyte past surface layer 24 and dimensionally stable anode 36 is substantially reduced in the region between termination point 54 and fluid level 22. Thus, in this region a substantially reduced capability for supporting current density is experienced, even though the applied voltage and spacing in this region are equal to the applied voltage and spacing in all other regions. The employment of a current density in excess of the maximum current density which gives smooth deposition of metal produces a roughened surface which enhances bonding of the deposited metal foil to a resinous substrate. By controlling the distance between termination point 54 and fluid level 22, the amount of metal deposited in a roughened condition as a percentage of the total deposited layer can be controlled. In addition, instead of merely terminating backing plate 34 at termination point 54, backing plate 34 may be continued to fluid level 22 but angled or stepped away from surface layer 24 to substantially reduce the fluid velocity in the terminal region specifically to reduce the maximum current density sustainable in this final region but to keep it above a level which would be produced by a simple termination as shown in FIG. 5.

Alternatively, the fluid velocity and agitation in this, or other regions may be modified by varying the openness of dimensionally stable anode 36. For example, the openness of dimensionally stable anode may be very small in lower portions to constrain fluid flow and bubbles, whereas it may be more open at higher regions to reduce flow velocity and agitation.

Figure 6:
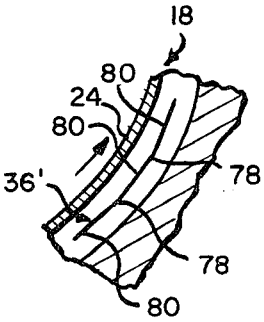
FIG. 6 is an enlarged cross section of an apparatus having a dimensionally stable anode which is deformed at bend lines parallel to the axis of the cylindrical cathode 18.

Referring now to FIG. 6, a dimensionally stable anode 36' is shown in which one or more bend lines 78 are parallel to the axis of cylindrical cathode 18 divide dimensionally stable anode 36' into a plurality of narrower planer panels 80. Each planar panel 80 may be considered the equivalent of the strips of dimensionally stable anode 36 of FIGS. 3-5. Bend lines 78 improve the rigidity of dimensionally stable anode 36'. Bend lines 78 are preferably formed prior to the creation of the coating on dimensionally stable anode 36'. By using a single dimensionally stable anode 36' to provide a plurality of planar panels 80, the labor involved in installation and removal of dimensionally stable anode 36' is reduced due to the smaller number of pieces which must be handled.

It is also within the contemplation of the invention that strips of dimensionally stable anode may be shaped in an arc having a radius located at the axis of cylindrical cathode 18.

Having described a specific preferred embodiment of the invention with reference to the accompanying drawings, it is to be understood that the invention is not limited to this precise embodiment and that various changes and modifications may be effected therein by one skilled in the art without departing from the scope or spirit of the invention as defined in the appended claims.

What is claimed is:

1. Apparatus for electrodeposition of a metal on a cylindrical cathode which is rotated about a horizontal axis and is partly submerged in an electrolyte, said cylindrical cathode having a surface layer thereon upon which metal from said electrolyte may be deposited and from which a deposited layer of said metal may be stripped, comprising a plurality of strips of dimensionally stable anode, means for supporting each of said plurality of strips parallel to said horizontal axis and spaced a predetermined distance from said surface layer to form a generally annular space between said surface and said plurality of strips extending about substantially the entire portion of said surface layer which is submerged in said electrolyte.

2. Apparatus according to claim 1, wherein each of said plurality of strips is planar.

3. Apparatus according to claim 1, wherein each of said plurality of strips extends at least a complete axial dimension of said cylindrical cathode.

4. Apparatus according to claim 1, wherein said means for supporting includes a backing plate spaced outward a predetermined distance from said strips of dimensionally stable anode.

5. Apparatus according to claim 1, wherein at least some of said strips of dimensionally stable anode include a plurality of holes therein effective to permit substantially free flow of said electrolyte through said strips from one side to the other side thereof.

6. Apparatus according to claim 5, wherein said means for supporting includes a backing plate spaced outward a predetermined distance from said strips of dimensionally stable anode, said backing plate being effective to prevent flow therethrough of said electrolyte, and means for supplying electrolyte between said cylindrical cathode and said backing plate at a low point thereof whereby a flow velocity of said electrolyte is produced between said cylindrical cathode and said backing plate.

7. Apparatus according to claim 6, wherein said flow velocity is effective to increase a maximum current density on said cylindrical cathode beyond a maximum for smooth deposition of metal on said surface layer in the absence of said flow velocity.

8. Apparatus according to claim 7, wherein said backing plate is terminated below a surface level of said electrolyte whereby said flow velocity is reduced past a portion of said surface layer below said maximum for smooth deposition of metal whereby an outer surface of said metal is roughened.

9. Apparatus according to claim 1, wherein at least one of said strips include at least one bend line parallel to said horizontal axis, each of said bend lines dividing said at least one strip into adjacent substantially planar panels.

10. Apparatus according to claim 1, wherein at least some of said strips having an arc-shaped cross section which has a radius centered on said horizontal axis.

11. Apparatus for electrodeposition of metal on a cylindrical cathode which is rotated about a horizontal axis and is partly submerged in an electrolyte, said cylindrical cathode having a surface layer thereon upon which metal from said electrolyte may be electrodeposited and from which a deposited layer of said metal may be stripped, comprising a backer plate spaced a first predetermined substantially uniform distance from said surface layer from a point where said surface layer enters said electrolyte to a point located a second predetermined distance below where said surface layer emerges from said electrolyte to form a substantially uniform annular space, strips of dimensionally stable anode having a plurality of holes therein which are effective to permit substantially free communication of said electrolyte from one side to the other thereof, means for supporting said strips a third predetermined substantially uniform distance away from said cylindrical cathode at least around an entire portion of a circumference of said cylindrical cathode which is submerged in said electrolyte, and means for flowing electrolyte into said annular space at a low point thereof in sufficient quantity to produce a flow velocity therethrough in said annular space which is high enough to substantially increase a maximum current density on said cylindrical cathode for the deposition of smooth metal thereon.

12. Apparatus for electrodeposition of a metal on a cylindrical cathode which is rotated about a horizontal axis and is partly submerged in an electrolyte flowing past the surface thereof, said cylindrical cathode having a surface layer thereon upon which metal from said electrolyte may be deposited and from which a deposited layer of said metal may be stripped, comprising an anode parallel to said horizontal axis and spaced a predetermined distance from said surface layer to form a generally annular space between said surface and said anode extending about substantially the entire portion of said surface layer which is submerged in said electrolyte, a portion of said anode at one end thereof comprising at least a strip of dimensionally stable foraminous material having sufficient permeability to permit said electrolyte to flow through said anode away from said cylindrical cathode to reduce the flow velocity of electrolyte adjacent said portion so that a maximum cathode current density for smooth metal deposition is exceeded in a portion of said cylindrical cathode just prior to its emergence and a roughened surface is imparted to said deposited layer of said metal.

13. Apparatus according to claim 12, wherein said anode comprises a plurality of juxtaposed dimensionally stable foraminous strips of material at said one end thereof.

14. Apparatus according to claim 13, wherein the remainder of said anode is fabricated from solid lead.

* * * * *